United States Patent [19]

Morrow, Sr.

[11] 4,143,856

[45] Mar. 13, 1979

[54] SPLIT DRIVE SYSTEM FOR DRAGLINE WITH POWER INTERLOCK

[75] Inventor: James G. Morrow, Sr., Manitowoc, Wis.

[73] Assignee: The Manitowoc Company, Inc., Manitowoc, Wis.

[21] Appl. No.: 835,871

[22] Filed: Sep. 23, 1977

[51] Int. Cl.[2] ..... B66D 1/26

[52] U.S. Cl. ..... 254/185 R; 37/116; 192/3.25

[58] Field of Search ..... 254/185 R, 184, 185 AB, 254/150 FH, 166; 37/115, 116, 135, 136; 212/38; 192/3.25; 74/718; 60/363

[56] References Cited

U.S. PATENT DOCUMENTS

| | | | |
|---|---|---|---|
| 1,555,906 | 10/1925 | Banke | 37/116 |
| 2,603,893 | 7/1952 | Trask | 37/135 |
| 3,221,896 | 12/1965 | Grall et al. | 254/185 R |
| 3,541,596 | 11/1970 | Larson | 254/185 R |
| 3,578,787 | 5/1971 | Brickett et al. | 254/185 R |
| 3,944,034 | 3/1976 | Ahlen | 192/3.25 |

*Primary Examiner*—Trygve M. Blix
*Assistant Examiner*—Kenneth W. Noland
*Attorney, Agent, or Firm*—Leydig, Voit, Osann, Mayer & Holt, Ltd.

[57] ABSTRACT

Separate torque converters are selectively clutched to the hoist and drag drums of a dragline machine with a selectively engageable clutch providing a power interlock of the output of both torque converters to either one of the drums as desired. Another clutch may be engaged to interlock the two drums together for joint operation by one of the torque converters. Dragline holdback may be achieved by the drag drum brakes, the drag drum converter or the drum interlock thereby providing the operator with considerable flexibility in controlling the path of the drag bucket during hoisting.

6 Claims, 5 Drawing Figures

21
17
19
18
10
22
26
23
24
35
28
16
31
20
33
29
12
13
15
11
14

SPLIT DRIVE SYSTEM FOR DRAGLINE WITH POWER INTERLOCK

The present invention relates generally to digging and hoisting machinery and more specifically concerns a split drive system for a dragline with a power interlock.

In a conventional dragline machine the hoist line is wound on one drum and the dragline is wound on a separate drum. After the bucket is dropped and the dragline reeved in to fill the bucket, tension must be maintained on the dragline during hoisting to prevent the bucket from dumping until the desired location is reached.

It is the primary aim of the present invention to provide a split drive from an engine to separate torque converters selectively clutched to the respective hoist and dragline drums with a selectively engageable power interlock for coupling the output of both torque converters together to jointly power either of the drums as desired. A more detailed object is to automatically render either of the hoist or dragline controls, when moved in one direction, operative to modulate both torque converters when the power interlock is engaged.

Another object is to provide a split drive of the above nature with a selectively engageable drum interlock for coupling the hoist and dragline drums together when either the hoist or dragline controls are moved in the opposite direction. A related object is to provide such a split drive system that, when both the power and drum interlock are disengaged, permits the dragline torque converter to provide the necessary holdback tension to prevent bucket dumping while permitting the operator to hoist the bucket along the desired path without undue use of the dragline brakes.

These and other objects and advantages of the invention will become apparent upon reading the following detailed description and upon reference to the drawings, in which.

While the invention will be described in connection with a preferred embodiment, it will be understood that we do not intend to limit the invention to the illustrated embodiment. On the contrary, we intend to cover all alternatives, modifications and equivalents as may be included within the spirit and scope of the invention as defined by the appended claims.

Figure 1:
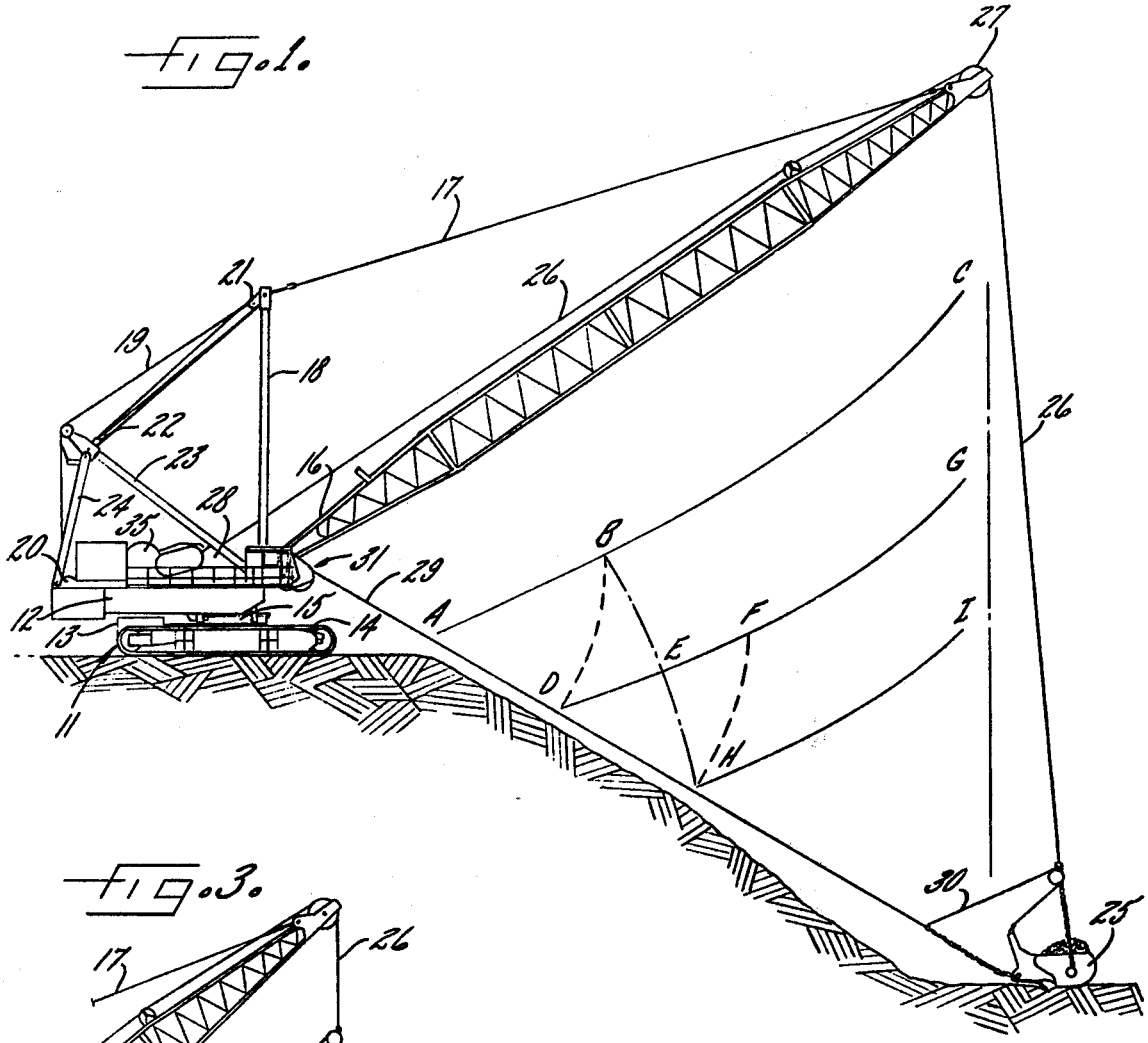
FIG. 1 is a side elevation of a dragline machine employing the split drive with power interlock of the present invention.
Figure 3:
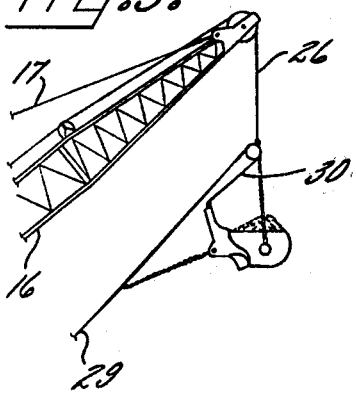
FIG. 3 is an enlarged fragmentary side elevation of the boom tip shown in FIG. 1 with the bucket in an elevated position.

Turning now to the drawings, there is shown in FIG. 1 a dragline machine 10 provided with the split drive and power interlock system of the present invention. The machine 10 includes self-propelled lower works 11 and rotatably mounted upper works 12.

In the preferred embodiment, the lower works 11 is in the form of a demountable, self-propelled transporter such as disclosed in U.S. Pat. No. 4,000,784 and copending application Ser. No. 685,689 now U.S. Pat. No. 4,069,884 and which are hereby incorporated by reference. Suffice it to say here that the lower works 11 includes an engine 13 which drives tracks 14 through a dual hydraulic motor drive arrangement as disclosed in the aforementioned application and carries a ring and roller path 15 on which the upper works 12 is supported and rotatably driven preferably as disclosed in U.S. Pat. Nos. 3,989,325 and 3,954,020 which are also incorporated herein by reference.

The upper works 12 includes a pivotally mounted boom 16 supported by pendants 17 attached to the upper end of a pivotally mounted mast 18. The boom 16 and mast 18 are pivoted in unison by a boom hoist line 19 which preferably has both ends wound on separate drums of a dual drum boom hoist 20 with multiple reaches of the line 19 extending between equalizer assemblies 21 and 22, respectively, carried at the upper ends of the mast 18 and a rearwardly extending gantry 23 supported on the upper works 12 by a back-hitch linkage 24.

Figure 4:
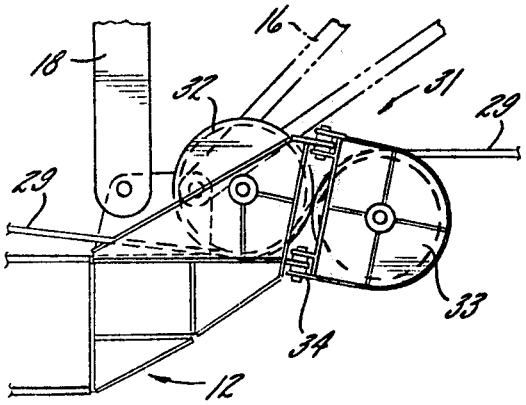
FIG. 4 is an enlarged fragmentary side elevation of the dragline fairlead assembly; and, FIG. 5 is a schematic view of the split drive with power interlock and the control circuit for the dragline of the present invention.

A drag bucket 25 is supported from the boom 16 by a hoist line 26 reeved over a sheave assembly 27 at the boom tip and wound on a hoist drum 28 carried on the upper works 12. A dragline 29 is attached to the forward end of the bucket with a holdback line 30 to control bucket dumping in the usual manner. The dragline 29 is guided into the lower works 12 by a fairlead assembly 31 consisting of two vertical sheaves 32 and 33 mounted in-line with each other. (See FIG. 4) The rear sheave 32 is mounted in a fixed frame and the front sheave 33 is mounted in a hinged frame 34 to provide proper fleeting of the line 29 onto a dragline drum 35.

Figure 2:
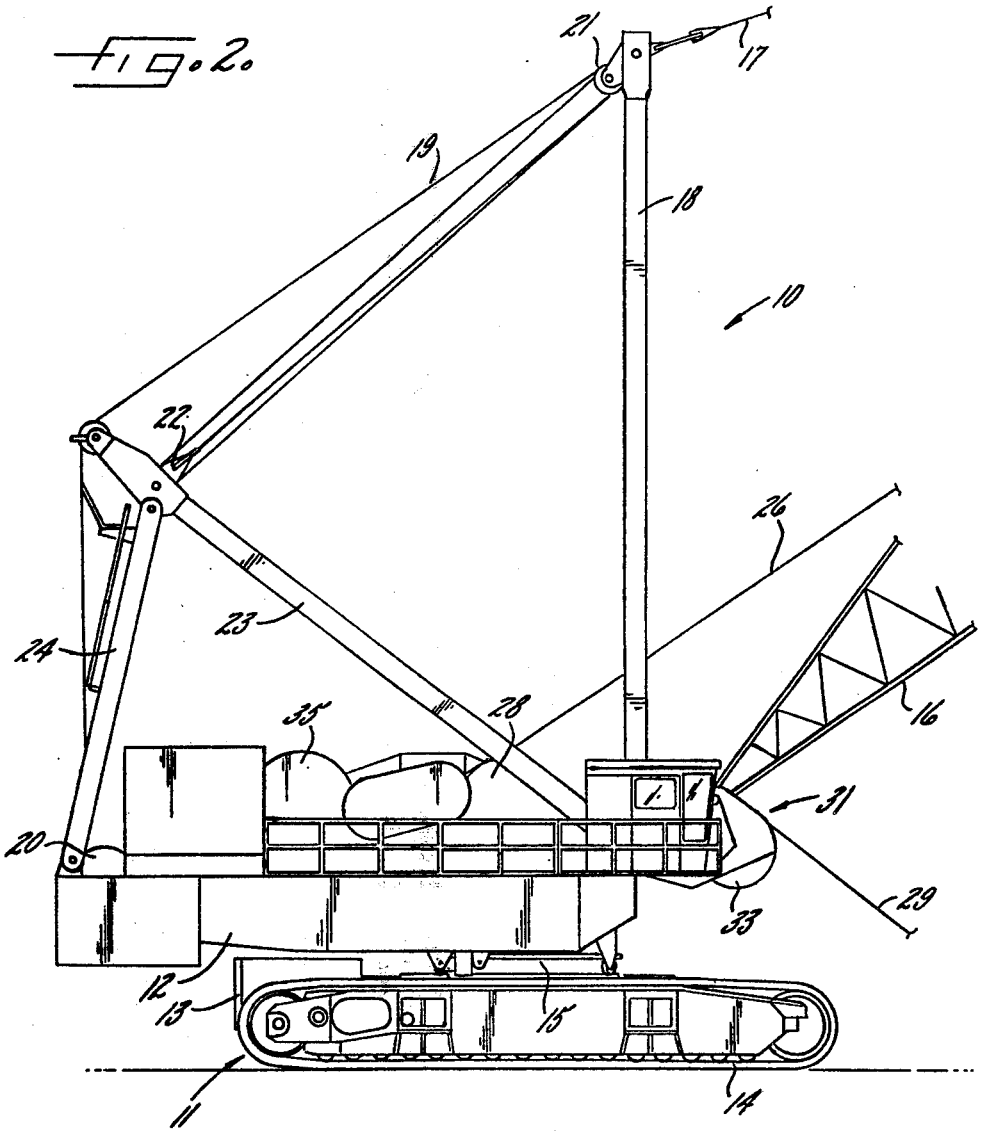
FIG. 2 is an enlarged fragmentary side elevation of the upper works of the dragline machine shown in FIG. 1.

In the preferred embodiment, the hoist line 26 is payed out from the top of the hoist drum 28 and the dragline 29 is payed out from the bottom of the drag drum 35. Thus as the hoist line 26 is reeved in (hoist drum 28 rotates counterclockwise as viewed in FIGS. 1 and 2), the dragline 29 is payed out (drag drum 35 also rotates counterclockwise as viewed in these Figures). Conversely, when the dragline 29 is reeved in (drag drum 35 rotates clockwise) and the hoist line 26 is payed out (hoist drum 28 also rotates clockwise).

Figure 5:
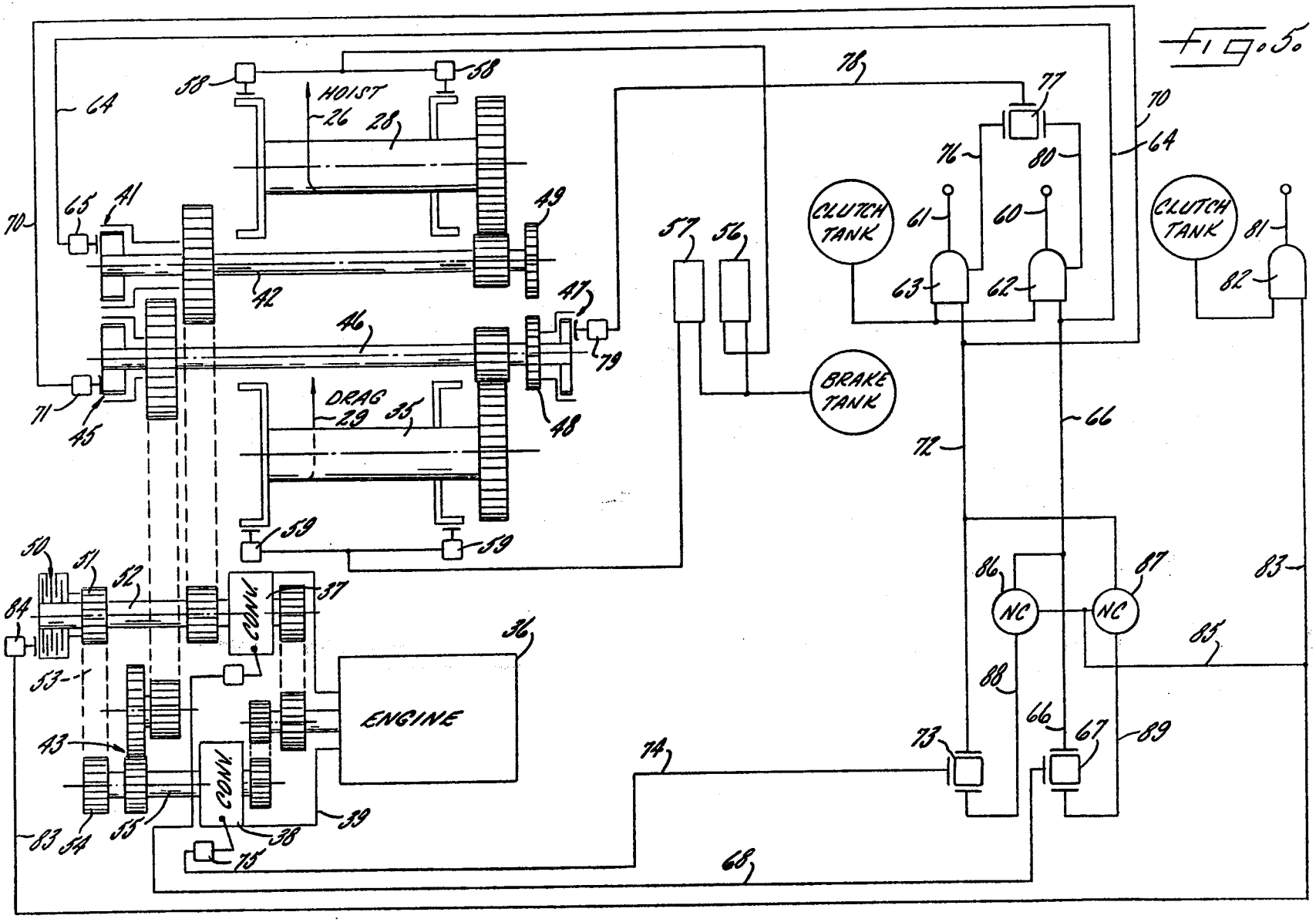

In accordance with the present invention, a split drive system is provided for the hoist drum 28 and drag drum 35. As shown schematically in FIG. 5, both drums 28 and 35 are normally driven by a single engine 36 through separate controlled torque converters 37 and 38, chain driven from the engine 36 through a transfer case 39. The hoist converter 37 powers the hoist drum 28 (counterclockwise) through a chain drive 40 coupled by a selectively engageable clutch 41 to a front countershaft 42 geared to the hoist drum. The drag drum converter 38 powers the drag drum 35 (clockwise) through an initial gear reduction 43 (which also reverses rotation) to a chain drive 44 coupled by a selectively engageable clutch 45 to a rear countershaft 46 geared to the drag drum 35. The two countershafts 42 and 46 (and thus the drums 28 and 35) may be interlocked together by energizing a dragline interlock clutch 47 coupling a sprocket 48 to the rear countershaft 46 which chain drives a sprocket 49 fixed on the front countershaft 42.

Pursuant to the present invention, the machine 10 also includes a power interlock to couple the output of both torque converters 37 and 38 together, when desired. Thus, a power interlock clutch 50 couples a sprocket 51 to the output shaft 52 of the dragline converter 33 which is connected by a chain drive 53 to a sprocket 54 on the output shaft 55 of the hoist converter 38. When the power interlock clutch 50 is engaged, power from both torque converters 37, 38 may be selectively delivered to either the hoist drum 28 or the drag drum 35 upon operation of the controls to be described below.

Separate brake pedals 56 and 57 operate pneumatic valves (which are supplied air from a brake tank) to energize respective actuators 58 and 59 for external type brake bands on the drums 28 and 35.

To apply power to the drums 28 and 35, spearate control levers 60 and 61, respectively, operate a pneumatic hoist valve 62 and a drag valve 63 which are supplied air under regulated pressure from a clutch tank. Initial rearward movement of the hoist lever 60 (clockwise in FIG. 5) sends air through line 64 to an actuator 65 which initiates engagement of the hoist drum clutch 41 and further rearward movement of the lever 60 sends air through line 66, shuttle valve 67 and line 68 to an actuator 69 which modulates the hoist converter 37. Thus, the drum clutch 41 is always sufficiently engaged to handle the torque delivered as the torque converter 37 is modulated. In a similar fashion, initial rearward movement (clockwise) of the drag lever 61 sends air through line 70 to an actuator 71 which initiates engagement of the drag drum clutch 45 and further rearward movement of the lever 61 sends air through line 72, shuttle valve 73 and line 74 to an actuator 75 which modulates the drag converter 38.

Forward movement of the drag lever 61 sends air through line 76, shuttle valve 77 and line 78 to an actuator 79 which engages the dragline interlock clutch 47. Likewise, forward movement of the hoist lever 60 sends air through line 80, shuttle valve 77 and line 78 to the actuator 79 to engage the interlock clutch 21.

A separate control handle 81 operates a valve 82 which sends air from a source (clutch tank) through a line 83 to an actuator 84 which engages the power interlock clutch 50 coupling the output shafts of the hoist and drag converters 37, 38 together. At the same time air is delivered through pilot line 85 to normally closed relay valves 86 and 87 which receive air pressure from the hoist and drag control lines 66 and 72, respectively, and which deliver air pressure through lines 88 and 89, respectively, to theopposite sides of shuttle valves 73 and 67. Thus, when the power interlock clutch 50 is engaged by operating handle 81, the normally closed valves 86 and 87 are opened and rearward movement of either the hoist lever 60 or drag lever 61 will operate to modulate both converters 37 and 38 thereby increasing the torque transmitted to either the hoist drum 28 or the drag drum 35 depending on which drum clutch 41 or 45 is engaged by operation of the respective control levers 60 or 61.

Once the drag bucket 25 is filled, it is necessary to maintain tension in the dragline 29 as the bucket is hoisted to prevent the bucket from dumping. One way to do this is to apply the drag drum brakes 59 by pressing on the brake pedal 57 as the load is hoisted. While this provides considerable operator flexibility in controlling the path of the bucket during hoisting, slipping the drag brakes 59 generates a large amount of friction heat and would soon wear out the brake linings under repeated cycles of operation.

When the dragline interlock clutch 47 is employed, hoisting begins as above with the operator engaging the hoist clutch 41 and applying the drag brakes 59. Once the hoist begins, the operator engages the interlock clutch 47 and removes his foot from the drag brake pedal 57. When the interlock clutch 47 is engaged, the weight of the bucket 25 pulls rope 29 off the drag drum 35, turning it in a reverse direction. Now the drag rope pull is transmitted to the hoist drum 28 via the interlock chain, thereby reducing the power required to hoist the bucket 25.

In the illustrated embodiment, with the boom 16 at an angle of 30° and the bucket 25 in the position indicated at B in FIG. 1, the amount of hoist and drag rope pull (as compared to the weight of the dragline bucket and contents taken as 100%) are approximately 214% and 165%, respectively. Thus, the hoist line pull required to lift the bucket is 214% of the weight of the loaded bucket. This is due to the holdback tension of dragline 29 and holdback line 30 which is necessary to maintain the proper bucket attitude so as to prevent dumping. In the preferred embodiment, the interlock chain and clutch 47 "tie" the hoist and drag drums 28 and 35 together. The tension, or holdback, in the drag rope 29 still exists but this is transferred through the interlock, to the hoist drum 28.

While a hoist rope pull of 214% is still required, the drag rope pull assists the hoist when the drum interlock clutch 47 is used. Drag rope tension in the amount of approximately 145% (165% less 20% friction loss) is therefore used to reduce the horsepower required to hoist the bucket 25. The power required to hoist the bucket is now 214–145 or 69% of the weight of the loaded bucket. From this example, it can be seen then that the dragline equipped with drum interlock clutch 47 requires only ⅓ the horsepower (69)/(214) to hoist the bucket 25 at a given speed or—the interlock—equipped dragline can hoist a given load faster than a machine equipped with a conventional power train using the drag brakes 59 as a holdback.

In addition, as pointed out above, the drag brakes on a conventional machine must absorb the horsepower required to hold a tension on the dargline causing heat and wear on the drag brakes. It is not necessary to use the drag brakes on the machine when using interlock since the inherent friction in the machinery plus the interlock is sufficient to maintain the tension in the drag rope 29. This, of course, means less maintenance on the illustrated machine and fuel costs are also lower, since less horsepower is used in hoisting the bucket.

Advantage can also be taken of the drum interlock when returning the bucket 25 to the cut. The interlock clutch 47 is engaged and the hoist brake 59 is released. Since the weight of the bucket—through the interlock—helps pull in the drag rope, the operator can lower and inhaul his bucket simultaneously without riding the hoist brake, thereby reducing hoist brake wear.

Pursuant to a further aspect of the invention and because separate torque converters 37 and 38 are provided for powering the hoist drum 28 and drag drum 35, the drag converter 38 can be partially engaged to provide the necessary holdback on the dragline 29 during hoisting. This gives the operator the greatest flexibility in controlling the path of the bucket 25 during hoisting. It also avoids undue drag drum brake wear since the dragline holdback tension is absorbed in the drag converter 38. However, the hoist converter 37 must supply more power (as compared to when the interlock clutch 47 is engaged) since there is no regenerative effect exerted by the drag drum 35 through the interlock clutch 47 to the hoist drum 28.

When maximum power (such as during drag bucket inhaul) or maximum speed such as during hoisting is desired, the power interlock clutch 50 may be engaged by operating control handle 81. This couples the output shafts 52 and 54 of both the hoist and drag converters 37 and 38 together to deliver maximum power to either the hoist drum 28 or drag drum 35 depending on which of the clutches 41 or 45 is engaged by operation of the respective hoist and drag control levers 60 and 61. It will also be appreciated, of course, that during high speed hoisting with the power interlock clutch 50 engaged, either the drag drum brakes 59 or the dragline interlock clutch 47 may be engaged to provide the necessary dragline tension to prevent bucket dumping. However, the drag converter 38 cannot now be used to provide holdback tension since it is coupled through the power interlock clutch 50 to drive the hoist drum 28.

In normal operation, the filled bucket 25 is hoisted and the upper works 12 including the boom 16 are rotated away from the cut so the bucket can be dumped into a truck or on a pile alongside of the cut. The upper works 12 and boom 16 are then rotated back into alignment with the cut as the bucket 25 is lowered by disengaging the hoist drum brakes 58. If the operator has good rhythm and timing, the bucket 25 can be cast out ahead of the boom tip and thus increase the reach of the drag bucket without moving the basic machine.

Alternatively, where close-in digging is desired, the drag interlock clutch 47 may be engaged in which case the dragline 29 is reeved in on the drag drum 35 as the weight of the bucket pays off the hoist line 26 from the hoist drum 28.

In keeping with the present invention, the split drive system with power interlock and drum interlock provides the dragline operator with great flexibility during hoisting. Referring now to FIG. 1, curve ABC represents the characteristic bucket path from point A (approximately the maximum bucket inhaul position) to point C (approximately the maximum hoist position) with the drum interlock clutch 47 engaged and an interlock ratio of 1:1. If, however, the bucket 25 is full at point D and hoisting begins with interlock clutch 47 engaged, the bucket follows curve DEFG. In this instance, it will also be noted that the maximum bucket hoist is reduced. This is because the sum of the lengths of the hoist line 26 and dragline 29 is greater at point D, when the interlock is engaged, than at point A. Moreover, if the bucket fills even earlier, for example at point H, and hoisting is initiated with the interlock clutch 47 engaged, the bucket will travel along curve HI. However, as can be seen in FIG. 1, the hoist height is so severely limited that the bucket will not even clear the spoil pile seen in the background.

Going back to point D in FIG. 1, if a higher hoist is desired, the drag drum brakes 59 may be clamped on during initial hoisting and the bucket path will follow curve DB. Then the interlock clutch 47 may be engaged and the bucket will follow curve BC. Similarly, the drag brakes may be applied earlier at point H, causing the bucket to follow curve HF before the interlock is engaged to establish curve FG.

Alternatively, if the bucket is full early as at point H, hoisting can be started while the drag drum is still drawing the bucket in. Assuming equal drag and hoist speeds, the bucket will follow curve HEB in FIG. 1. At point B the interlock can now be engaged and the bucket will follow the upper interlock curve BC.

The system of the present invention, of course, provides many other variations. For example, if the drag brakes 59 are allowed to slip, curves DB or HF will rotate out in a clockwise direction as seen in FIG. 1. In fact, if the drag brakes 59 are slipped so as to pay out the dragline 29 at a 1:1 ratio to the hoist line 26, curve DB will be the same as interlock curve DF. Additionally, from a tight-in position such as A, slipping the drag brakes 59 even more would cause the bucket 25 to travel from A to E; but considerable operator skill would be required to avoid premature dumping of the bucket. Because of the flexibility of the present invention, similar bucket paths can also be generated by modulating the drag converter 38 instead of slipping the drag brakes 59. And, as noted above, full engagement of the drag converter 38 at the same speed as the hoist converter 37 would rotate curve HF counterclockwise onto the HE curve as seen in FIG. 1.

From the foregoing, it will be appreciated that the present invention provides a highly versatile dragline drive system with separate torque converters 37, 38 for the hoist and drag drums 28, 35 which may be interlocked together at 47. A separate power interlock clutch 50 also permits full power to be delivered to either of the drums 28, 35 when desired.

I claim as my invention:

1. A split drive system for a dragline having a hoist drum and a drag drum comprising, in combination, a power source, means including a first torque converter having an output shaft and a first selectively engageable clutch for interconnecting said power source and said hoist drum, means including a second torque converter having an output shaft and a second selectively engageable clutch for interconnecting said power source and said drag drum, drum interlock means for selectively coupling said drums together, hoist control means movable in one directon for engaging said first clutch and for modulating said first torque converter, said hoist control means being movable in the opposite direction for engaging said drum interlock means, drag control means movable in one direction for engaging said second clutch and for modulating said second torque converter, power interlock means for selectively coupling said output shafts together, and control means for engaging said power interlock means and for automatically rendering said drag control means operative when moved in said one direction for selectively modulating both of said first and second torque converters.

2. The combination defined in claim 1 wherein each of said first and second clutches includes a pneumatic actuator biased toward disengagement and said means for modulating said first and second torque converters each includes a pneumatic actuator biased toward neutral such that said clutch actuators are operable to partially engage said clutches prior to modulation of said respective torque converters.

3. The combination defined in claim 2 including a shuttle valve interposed between said hoist control means and said hoist converter modulating means and a normally closed valve between the drag control and said shuttle valve, said normally closed valve being opened when said power interlock control is engaged.

4. A split drive system for a dragline having a hoist drum and a drag drum comprising, in combination, a power source, means including a first torque converter having an output shaft and a first selectively engageable clutch for interconnecting said power source and said hoist drum, means including a second torque converter having an output shaft and a second selectively engageable clutch for interconnecting said power source and said drag drum, drum interlock means for selectively coupling said drums together, hoist control means movable in one direction for engaging said first clutch and for modulating said first torque converter, drag control means movable in one direction for engaging said second clutch and for modulating said second torque converter, said drag control means being movable in the opposite direction for engaging said drum interlock means, power interlock means for selectively coupling said output shafts together, and control means for engaging said power interlock means and for automatically rendering said hoist control means operative when moved in said one direction for selectively modulating both of said first and second torque converters.

5. The combination defined in claim 4 wherein each of said first and second clutches includes a pneumatic actuator biased toward disengagement and said means for modulating said first and second torque converters each includes a pneumatic actuator biased toward neutral such that said clutch actuators are operable to partially engage said clutches prior to modulation of said respective torque converters.

6. The combination defined in claim 5 including a shuttle valve interposed between said hoist control means and said drag converter modulating means a normally closed valve between the hoist control and said shuttle valve, said normally closed valve being opened when said power interlock control is engaged.

* * * * *